US006350323B1

(12) United States Patent
Inoue et al.

(10) Patent No.: US 6,350,323 B1
(45) Date of Patent: Feb. 26, 2002

(54) HIGH PERMEABILITY METAL GLASSY ALLOY FOR HIGH FREQUENCIES

(75) Inventors: Akihisa Inoue, 11-806 Kawauchijutaku, 35 Motohasekura, Kawauchi, Aoba-ku, Sendai-shi, Miyagi-ken; Tao Zhang, Miyagi-ken, both of (JP)

(73) Assignees: Alps Electronic Co., Ltd., Tokyo; Akihisa Inoue, Miyagi-ken, both of (JP)

( * ) Notice: Subject to any disclaimer, the term of this patent is extended or adjusted under 35 U.S.C. 154(b) by 0 days.

(21) Appl. No.: 09/388,761

(22) Filed: Sep. 2, 1999

(30) Foreign Application Priority Data

Jan. 8, 1999 (JP) ..... 11-003529

(51) Int. Cl.[7] ..... H01F 1/04

(52) U.S. Cl. ..... 148/304; 148/306; 148/310; 148/311; 148/313; 148/330; 148/425; 420/121; 420/435; 420/440

(58) Field of Search ..... 148/304, 306, 148/310, 311, 313, 330, 425; 420/121, 435, 440

(56) References Cited

U.S. PATENT DOCUMENTS 4,140,525 A * 2/1979 Ray ..... 75/126 P
4,221,592 A * 9/1980 Ray ..... 75/122
4,755,239 A * 7/1988 O'Handley ..... 148/304
5,738,733 A 4/1998 Inoue

FOREIGN PATENT DOCUMENTS

| | | |
|---|---|---|
| DE | 19802349 A1 * | 7/1998 |
| JP | 10-324939 | 1/1998 |
| JP | 11-131199 | 5/1999 |

OTHER PUBLICATIONS

Derwent Abstract of Research Disclosure 356019 A, Dec. 10, 1993, Allied–Signal Inc.*

* cited by examiner

*Primary Examiner*—John Sheehan
*Assistant Examiner*—Andrew L. Oltmans
(74) *Attorney, Agent, or Firm*—Brinks Hofer Gilson & Lione

(57) ABSTRACT

A high permeability metal glassy alloy for high frequencies contains at least one element of Fe, Co, and Ni as a main component, at least one element of Zr, Nb, Ta, Hf, Mo, Ti, V, Cr, and W, and B. In the metal glassy alloy, the temperature interval ΔTx of a super cooled liquid region, which is represented by the equation ΔTx=Tx−Tg (wherein Tx represents the crystallization temperature, and Tg represents the glass transition temperature) is 20° C. or more, and resistivity is 200 μΩ·cm or more.

47 Claims, 16 Drawing Sheets

HIGH PERMEABILITY METAL GLASSY ALLOY FOR HIGH FREQUENCIES

BACKGROUND OF THE INVENTION

1. Field of the Invention

The present invention relates to a high permeability metal glassy alloy for high frequencies which has high electric resistance and high magnetic permeability in a high frequency region.

2. Description of the Related Art

Some of multi-element alloys have the property that in quenching a composition in a melt state, the composition is not crystallized but is transferred to a glassy solid through a super cooled liquid state having a predetermined temperature width. This type of amorphous alloy is referred to as a "metal glassy alloy". Examples of conventional known amorphous alloys include Fe—P—C system amorphous alloys first produced in the 1960s, (Fe, Co, Ni)—P—B system and (Fe, Co, Ni)—Si—B system amorphous alloys produced in the 1970s, (Fe, Co, Ni)—M(Zr, Hf, Nb) system amorphous alloys and (Fe, Co, Ni)—M(Zr, Hf, Nb)—B system amorphous alloys produced in the 1980s, and the like. Since these amorphous alloys have magnetism, they are expected to be used as amorphous magnetic materials as molding materials such as a core material of a transformer, and the like.

However, all of these amorphous alloys generally have a super cooled liquid region having a small temperature interval ΔTx, i.e., a small difference (Tx−Tg) between the crystallization (Tx) and the glass transition temperature (Tg), and must be thus produced by quenching at a cooling rate in the $10^{5°}$ C./s (K/s) level by a melt quenching method such as a single roll method or the like. The product has the shape of a ribbon having a thickness of 50 μm or less, and a bulky amorphous solid cannot be obtained.

Examples of metal glassy alloys which have a super cooled liquid region having a relatively large temperature interval, and from which amorphous solids can be obtained by slowly cooling include Ln—Al—TM, Mg—Ln—TM, and Zr—Al—TM (wherein Ln represents a rare earth element, and TM represents a transition metal) system alloys produced in 1988 to 1991, and the like. Although amorphous solids having a thickness of several mm are obtained from these metal glassy alloys, these alloys have no magnetism and thus cannot be used as magnetic materials.

Examples of conventional known amorphous alloys having magnetism include Fe—Si—B system alloys. Such amorphous alloys have a high saturation flux density, but sufficient soft magnetic characteristics cannot be obtained. Also these amorphous alloys have low heat resistance, a low electric resistance, and low magnetic permeability in a frequency region of 1 kHZ or more, particularly in a high frequency region of 100 kHz or more, thereby causing the problem of a large eddy current loss in use as a core material for a transformer, or the like.

On the other hand, Co-based amorphous alloys such as Co—Fe—Ni—Mo—Si—B system amorphous alloys and the like have excellent soft magnetic properties. However, such amorphous alloys have poor thermal stability and insufficient electric resistance, thereby causing the practical problem of a large eddy current loss in use as a core material for a transformer, or the like.

Furthermore, amorphous materials can be formed from these Fe—Si—B system and Co-based amorphous alloys only under conditions in which a melt is quenched, as described above, and a bulky solid can be formed only by the steps of grinding a ribbon obtained by quenching a melt, and then sintering the powder under pressure. There are the problems of a large number of required steps, and the brittleness of the molded product.

SUMMARY OF THE INVENTION

Accordingly, it is a first object of the present invention to provide a high permeability metal glassy alloy for high frequencies, which has a large temperature interval of a super cooled liquid region, which exhibits soft magnetism at room temperature, and which has the possibility that it can be produced in a thicker shape than amorphous alloy ribbons obtained by a conventional melt cooling method, as well as low magnetostriction, high electric resistance, and high magnetic permeability in a high frequency region.

A second object of the present invention is to provide a high permeability metal glassy alloy for high frequencies comprising at least one element of Fe, Co, and Ni as a main component, at least one element of Zr, Nb, Ta, Hf, Mo, Ti, V, Cr and W, and B, wherein the super cooled liquid region has a temperature interval ΔTx of 20° C. (K) or more, which is represented by the equation ΔTx=Tx−Tg (wherein Tx represents the crystallization temperature, and Tg represents the glass transition temperature), and the electric resistance is 200 μΩ·cm or more.

The above-described high permeability metal glassy alloy for high frequencies is represented by the following composition formula:

$$T_{100-x-y}M_xB_y$$

wherein T is at least one element of Fe, Co and Ni, M is at least one element of Zr, Nb, Ta, Hf, Mo, Ti, V, Cr and W, 4 atomic %≦x≦15 atomic %, and 22 atomic %≦y≦33 atomic %.

The high permeability glassy alloy for high frequencies having the above construction preferably has ΔTx of 50° C. (K) or more, and satisfies the relations 5 atomic %≦x≦12 atomic %, and 22 atomic %≦y≦33 atomic % in the composition formula $T_{100-x-y}M_xB_y$.

The high permeability glassy alloy for high frequencies having the above construction preferably has ΔTx of 60° C. (K) or more, and satisfies the relations 6 atomic %≦x≦10 atomic %, and 25 atomic %≦y≦32 atomic % in the composition formula $T_{100-x-y}M_xB_y$.

The above-described high permeability metal glassy alloy for high frequencies may be represented by the following composition formula:

$$(Fe_{1-a-b}Co_aNi_b)_{100-x-y}M_xB_y$$

wherein M is at least one element of Zr, Nb, Ta, Hf, Mo, Ti, V, Cr and W, 0≦a≦0.85, 0≦b≦0.45, 4 atomic %≦x≦15 atomic %, and 22 atomic %≦y≦33 atomic %.

The high permeability glassy alloy for high frequencies having the above construction preferably has ΔTx of 70° C. (K) or more, and satisfies the relations 0≦a≦0.75, and 0≦b≦0.35 in the composition formula $(Fe_{1-a-b}Co_aNi_b)_{100-x-y}M_xB_y$.

The high permeability glassy alloy for high frequencies having the above construction preferably has ΔTx of 80° C. (K) or more, and satisfies the relations 0.08≦a≦0.65, and 0≦b ≦0.2 in the composition formula $(Fe_{1-a-b}Co_aNi_b)_{100-x-y}M_xB_y$.

The above-described high permeability metal glassy alloy for high frequencies may be represented by the following composition formula:

$$CO_{100-z-v-w-q}E_zM_vB_wL_q$$

wherein E is at least one element of Fe and Ni, M is at least one element of Zr, Nb, Ta, Hf, Mo, Ti, V, Cr and W, L is at lease one element of Cr, Mn, Ru, Rh, Pd, Os, Ir, Pt, Al, Ga, Si, Ge, C and P, 0 atomic %≦z≦30 atomic %, 4 atomic % ≦v ≦15 atomic %, 22 atomic % ≦w ≦33 atomic %, and 0 atomic %≦q≦10 atomic %.

Furthermore, the high permeability metal glassy alloy for high frequencies of the present invention may have a magnetic permeability of 20000 or more at 1 kHz.

DESCRIPTION OF THE PREFERRED EMBODIMENT

Figure 1:
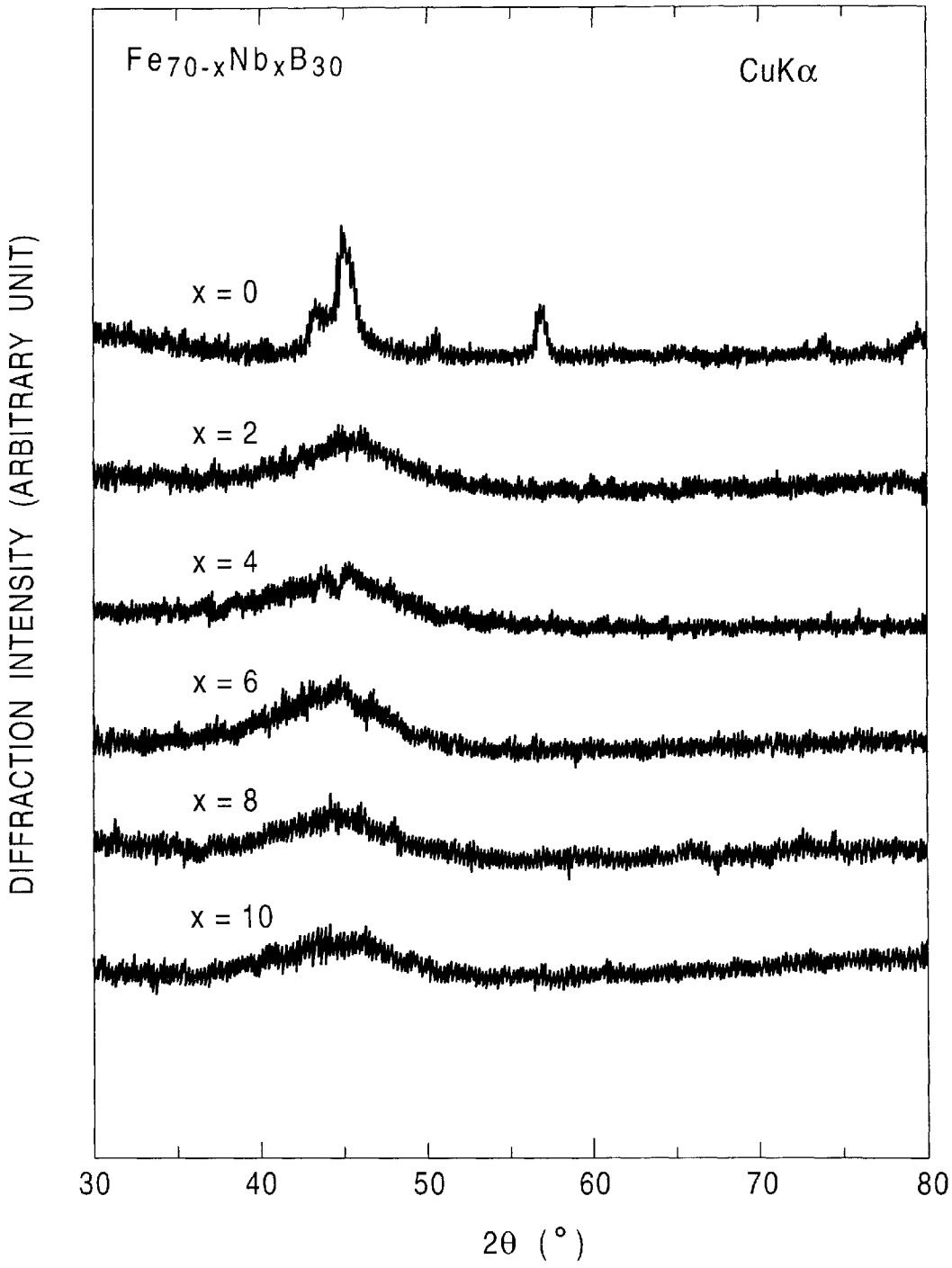
FIG. 1 is a chart showing X ray diffraction patterns of as-quenched samples having the composition $Fe_{70-x}Nb_xB_{30}$ (x=0, 2, 4, 6, 8 or 10 atomic %) in production by the single roll method.

A high permeability metal glassy alloy for high frequencies of the present invention will be described below.

The high permeability metal glassy alloy for high frequencies of the present invention is realized by a component system comprising at least one element of Fe, Co, and Ni as a main component, to which at least one element of Zr, Nb, Ta, Hf, Mo, Ti, V, Cr, and W, and B are added in predetermined amounts.

The above component system has a glass transition temperature Tg, and the super cooled liquid region has a temperature interval ΔTx of 20° C. (K) or more, which is represented by the equation ΔTx=Tx−Tg (wherein Tx represents the crystallization temperature, and Tg represents the glass transition temperature). A composition which satisfies these conditions has a wide super cooled liquid region of 20° C. (K) or more on the temperature side lower than the crystallization temperature Tx in cooling the composition in a melt state, and thus forms an amorphous metal glassy alloy at the glass transition temperature after passing through the temperature interval ΔTx of the super cooled liquid region without crystallization with temperature decreases. Since the temperature interval ΔTx of the super cooled liquid region is as large as 20° C. (K) or more, unlike conventional known amorphous alloys, an amorphous solid can be obtained without quenching. Therefore, it is possible to mold a thick block by a method such as casting or the like.

Furthermore, the above component system metal glassy alloy has resistivity of 200 μΩ·cm or more.

The high permeability metal glassy alloy for high frequencies of the present invention has a composition represented by the following formula 1:

$$T_{100-x-y}M_xB_y \qquad \text{Formula 1:}$$

wherein T is at least one element of Fe, Co and Ni, M is at least one element of Zr, Nb, Ta, Hf, Mo, Ti, V, Cr and W, 4 atomic %≦x≦15 atomic %, and 22 atomic %≦y≦33 atomic %.

The above composition formula $T_{100-x-y}M_xB_y$ preferably has the relation 52 atomic %≦100−x−y≦74 atomic %.

The composition formula $T_{100-x-y}M_xB_y$ preferably has the relation 22 atomic %≦y≦33 atomic %.

The composition system preferably has ΔTx of 50° C. (K) or more, and satisfies the relations 5 atomic %≦x≦12 atomic %, and 22 atomic %≦y≦33 atomic % in the composition formula $T_{100-x-y}M_xB_y$.

The composition system preferably has ΔTx of 60° C. (K) or more, and satisfies the relations 6 atomic %≦x≦10 atomic %, and 25 atomic %≦y≦32 atomic % in the composition formula $T_{100-x-y}M_xB_y$.

The above-described high permeability metal glassy alloy for high frequencies of the present invention has a composition represented by the following formula 2:

$$(Fe_{1-a-b}Co_aNi_b)_{100-x-y}M_xB_y \qquad \text{Formula 2:}$$

wherein M is at least one element of Zr, Nb, Ta, Hf, Mo, Ti, V, Cr and W, $0 \leqq a \leqq 0.85$, $0 \leqq b \leqq 0.45$, 4 atomic $\% \leqq x \leqq 15$ atomic %, and 22 atomic $\% \leqq y \leqq 33$ atomic %.

The above composition formula $(Fe_{1-a-b}Co_a Ni_b)_{100-x-y}M_xB_y$ preferably has the relation 52 atomic $\% \leqq 100-x-y \leqq 74$ atomic %.

The composition formula $(Fe_{1-a-b}Co_aNi_b)_{100-x-y}M_xB_y$ preferably has the relation 22 atomic $\% \leqq y \leqq 33$ atomic %.

The composition system preferably has ΔTx of 70° C. (K) or more, and satisfies the relations $0 \leqq a \leqq 0.75$, and $0 \leqq b \leqq 0.35$ in the composition formula $(Fe_{1-a-b}Co_a Ni_b)_{100-x-y}M_xB_y$.

The composition system preferably has ΔTx of 80° C. (K) or more, and satisfies the relations $0.08 \leqq a \leqq 0.65$, and $0 \leqq b \leqq 0.2$ in the composition formula $(Fe_{1-a-b}Co_a Ni_b)_{100-x-y}M_xB_y$.

The high permeability metal glassy alloy for high frequencies of the present invention preferably has either of the above compositions and is subjected to heat treatment at 427° C. (700 K) to 627° C. (900 K). The metal glassy alloy subjected to heat treatment in this temperature range exhibits high magnetic permeability.

The above composition system high permeability metal glassy alloy for high frequencies may be characterized by a magnetic permeability of 20000 or more at 1 kHz.

In the above composition system metal glassy alloy, at least one element T of Fe, Co and Ni as a main component is an element having magnetism, and is important for obtaining a high saturation magnetic flux density and excellent soft magnetic properties. In a composition system containing Fe, ΔTx is readily increased, and the ΔTx value can be increased to 20° C. (K) or more by controlling the Co and Ni contents to proper values. Specifically, in order to obtain ΔTx of 20° C. (K) to 70° C. (K), it is preferable to control the a value representing the Co composition ratio to $0 \leqq a \leqq 0.85$, and the b value representing the Ni composition ratio to $0 \leqq b \leqq 0.45$. In order to securely obtain ΔTx of 70° C. (K) or more, it is preferable to control the a value representing the Co composition ratio to $0 \leqq a \leqq 0.75$, and the b value representing the Ni composition ratio to $0 \leqq b \leqq 0.35$. In order to securely obtain ΔTx of 80° C. (K) or more, it is preferable to control the a value representing the Co composition ratio to $0.08 \leqq a \leqq 0.65$, and the b value representing the Ni composition ratio to $0 \leqq b \leqq 0.2$.

In order to obtain good soft magnetic properties in the above ranges, it is preferable to control the a value representing the Co composition ratio to $0.042 \leqq a \leqq 0.25$; in order to obtain a high saturation flux density, it is more preferable to control the b value representing the Ni composition ratio to $0.042 \leqq b \leqq 0.1$.

M is at least one element of Zr, Nb, Ta, Hf, Mo, Ti, V, Cr and W. These elements have the effect of increasing ΔTx, and are effective elements for producing amorphous materials. The content of M is preferably in the range of 4 atomic % to 15 atomic %. In order to obtain ΔTx of 50° C. K or more, and high magnetic properties, the content of M is preferably 5 atomic % to 12 atomic %; in order to obtain ΔTx of 60° C. (K) or more, and high magnetic properties, the content of M is preferably 6 atomic % to 10 atomic %.

Of these elements M, Nb is particularly effective.

B has a high amorphous forming ability, and is added in a range of 22 atomic % to 33 atomic % in order to increase resistivity to increase magnetic permeability in the high frequency region. With a B content of less than 22 atomic % beyond the range, the sufficient amorphous forming ability is not obtained, and ΔTx and resistivity are decreased, causing low magnetic permeability in the high frequency region. While a B content of over 33 atomic %, magnetic properties such as magnetization, etc. deteriorate, and embrittlement becomes significant. In order to obtain the higher amorphous forming ability, higher electric resistance and magnetic permeability in the high frequency region, the B content is preferably 22 atomic % to 33 atomic %, more preferably 23 atomic % to 33 atomic %, most preferably 25 atomic % to 32 atomic %.

The composition system may further contain at least one element of Ru, Rh, Pd, Os, Ir, PT, Al, Si, Ge, C and P. In the present invention, these elements can be added in the range of 0 atomic % to 5 atomic %. These elements are added mainly for improving corrosion resistance. The addition of these elements beyond this range deteriorates soft magnetic properties, as well as the amorphous forming ability.

In order to produce the above-described composition system high permeability metal glassy alloy for high frequencies, for example, a single element powder of each of the components is prepared, and the element powders are mixed so that the above composition ranges are obtained. Then, the powder mixture is melted by a melting device such as a crucible or the like in an inert gas atmosphere of Ar gas or the like to obtain an alloy melt having the predetermined composition.

Next, the alloy melt is quenched by the single roll method to obtain a soft magnetic metal glassy alloy. The single roll method comprises quenching the melt by blowing the melt to a rotating metallic roll to obtain a ribbon-shaped metal glassy alloy.

The high permeability metal glassy alloy for high frequencies of the present invention has a composition represented by the following formula 3:

$$Co_{100-z-v-w-q}E_zM_vB_wL_q \qquad \text{Formula 3:}$$

wherein E is at least one element of Fe and Ni, M is at least one element of Zr, Nb, Ta, Hf, Mo, Ti, V, Cr and W, L is at lease one element of Cr, Mn, Ru, Rh, Pd, Os, Ir, Pt, Al, Ga, Si, Ge, C and P, 0 atomic $\% \leqq z \leqq 30$ atomic %, 4 atomic $\% \leqq v \leqq 15$ atomic %, 22 atomic $\% \leqq w \leqq 33$ atomic %, and 0 atomic $\% \leqq q \leqq 10$ atomic %.

The above composition formula $Co_{100-z-v-w-q}E_zM_vB_wL_q$ preferably has the relation 12 atomic $\% \leqq 100-z-v-w-q \leqq 74$ atomic %.

The composition formula $Co_{100-z-v-w-q}E_zM_vB_wL_q$ preferably has the relation 22 atomic $\% \leqq w \leqq 33$ atomic %.

Furthermore, the high permeability metal glassy alloy for high frequencies of the composition system represented by formula 3 may be characterized by a magnetic permeability of 20000 or more at 1 kHz.

In the high permeability metal glassy alloy for high frequencies represented by formula 3, the element groups integrally form an amorphous alloy having soft magnetic properties, but each of the element groups possibly contributes to the following characteristics:

Co: Serving as a base of the alloy and bearing magnetism.

E group: Although the elements of E group also bear magnetism, particularly mixing 8 atomic % or more of Fe produces a glass transition temperature Tg, and readily produces the super cooled liquid state. However, with over 30 atomic % of Fe, magnetostriction is increased to $1 \times 10^{-6}$ or more.

M group: The elements of M group have the effect of widening the temperature interval ΔTx of the super cooled liquid region, and facilitate the formation of an amorphous material. With a mixing amount of less than 4 atomic %, no glass transition temperature Tg appears, while with a mixing amount of over 15 atomic %, magnetic properties deteriorate, and particularly magnetization deteriorates.

L group: The elements of L group have the effect of improving corrosion resistance of the alloy. With a large mixing amount of over 10 atomic %, magnetic properties and the amorphous forming ability deteriorate.

B: This element has the high amorphous forming ability. Mixing 33 atomic % or less of B has the effects of increasing the resistivity, increasing magnetic permeability in the high frequency region, and increasing thermal stability. With a mixing amount of less than 22 atomic %, the amorphous forming ability is insufficient, and ΔTx and resistivity are decreased, decreasing magnetic permeability in the high frequency region. With a mixing amount of over 33 atomic %, magnetic properties such as magnetization, etc. deteriorate, and embrittlement becomes significant.

In the high permeability metal glassy alloy for high frequencies represented by formula 3, particularly, when $14 \leqq v \leqq 15$ (atomic %), the temperature interval ΔTx of the super cooled liquid region is as large as 20° C. (K) or more.

Of the M group elements, Nb is preferred.

In order to obtain the high permeability metal glassy alloy for high frequencies having low magnetostriction, the mixing amount z of the E group element (Fe and/or Ni) is preferably in the range of 0 atomic % to 20 atomic %. This can widen ΔTx, and decrease the absolute value of magnetostriction to $10\times10^{-6}$ or less. The mixing amount z of the E group element is preferably in the range of 0 atomic % to 8 atomic %. This can decrease the absolute value of magnetostriction to $5\times10^{-6}$ or less. The mixing amount z of the E group element is more preferably in the range of 0 atomic % to 3 atomic %. This can decrease the absolute value of magnetostriction to $1\times10^{-6}$ or less.

In order to produce the high permeability metal glassy alloy for high frequencies represented by formula 3, a melt of a composition containing the above-described elements must be solidified by cooling with the super cooled liquid state maintained. General cooling methods include a rapid cooling method, and a slow cooling method. A known example of the rapid cooling method is the single roll method. This method comprises mixing element single powders of the respective components to obtain the above-described composition ratios, melting the power mixture by a melting device such as a crucible or the like in an inert gas atmosphere of Ar gas of the like to form a melt, and then quenching the melt by blowing the melt to a rotating cooling metallic roll to obtain a ribbon-shaped metal glassy alloy solid.

The thus-obtained ribbon is ground, and the resultant amorphous powder is placed in a mold, and then sintered by heating at a temperature which causes fusion of the power surfaces under pressure to produce a block molded product. When the temperature interval ΔTx of the super cooled liquid region is sufficiently large, in cooling the alloy melt by the single roll method, the cooling rate can be decreased, thereby obtaining a relatively thick plate-like solid. For example, a core material of a transformer, or the like can be molded. The high permeability metal glassy alloy for high frequencies of the present invention can also be cast by slow cooling with a casting mold because the temperature interval ΔTx of the super cooled liquid region is sufficiently large. Furthermore, a fine wire can be formed by submerged spinning, and a thin film can be formed by sputtering, deposition, or the like.

As described in detail above, the high permeability metal glassy alloy for high frequencies of the present invention has the above-mentioned construction, thus has the super cooled liquid region having a large temperature interval ΔTx, exhibits soft magnetism at room temperature, low magnetostriction, high resistivity, and high magnetic permeability in the high frequency region, and can be formed in a thicker shape than amorphous alloy ribbons obtained by the conventional melt quenching method. Therefore, the metal glassy alloy is useful for members of a transformer and a magnetic head. Furthermore, since the metal glassy alloy exhibits the so-called MI effect in which when an AC current is applied to a magnetic material, a voltage occurs in a base material due to impedance, and the amplitude changes with an external magnetic field in the length direction of the base material, the alloy can also be applied to MI elements.

EXAMPLES

Single pure metals of Fe and Nb, and boron pure crystals were mixed in an Ar gas atmosphere, and the resultant mixture was melted by an arc to produce a master alloy.

Next, the master alloy was melted by a crucible, and quenched by the single roll method comprising blowing the melt to a copper roll rotated at 40 m/s from a nozzle having a diameter of 0.4 mm at the lower end of the crucible under an injection pressure of $0.39\times10^5$ Pa in an argon gas atmosphere to produce a metal glassy alloy ribbon sample having a width of 0.4 to 1 mm and a thickness of 13 to 22 μm. The thus-obtained sample was analyzed by X ray diffraction and differential scanning calorimetry (DSC), and observed on a transmission electron microscope (TEM). Also, magnetic permeability was measured in the temperature range of room temperature to Curie temperature by a vibrating sample magnetometer (VSM), a B-H loop was obtained by a B-H loop tracer, and magnetic permeability at 1 kHz was measured by an impedance analyzer.

FIG. 1 shows X ray diffraction patterns of samples having the composition $Fe_{70-x}Nb_xB_{30}$ (x=0, 2, 4, 6, 8 or 10 atomic %) immediately after quenching in production by the single roll method.

Of the obtained patterns, the pattern of a sample having zero Nb content shows a peak which is possibly due to a crystal phase, and patterns of samples containing 2 atomic % (at %) or more of Nb are typical broad patterns showing an amorphous phase, and apparently indicate that these samples are amorphous. It is also found that the amorphous forming ability can be improved by increasing the amount of Nb added.

Figure 2:
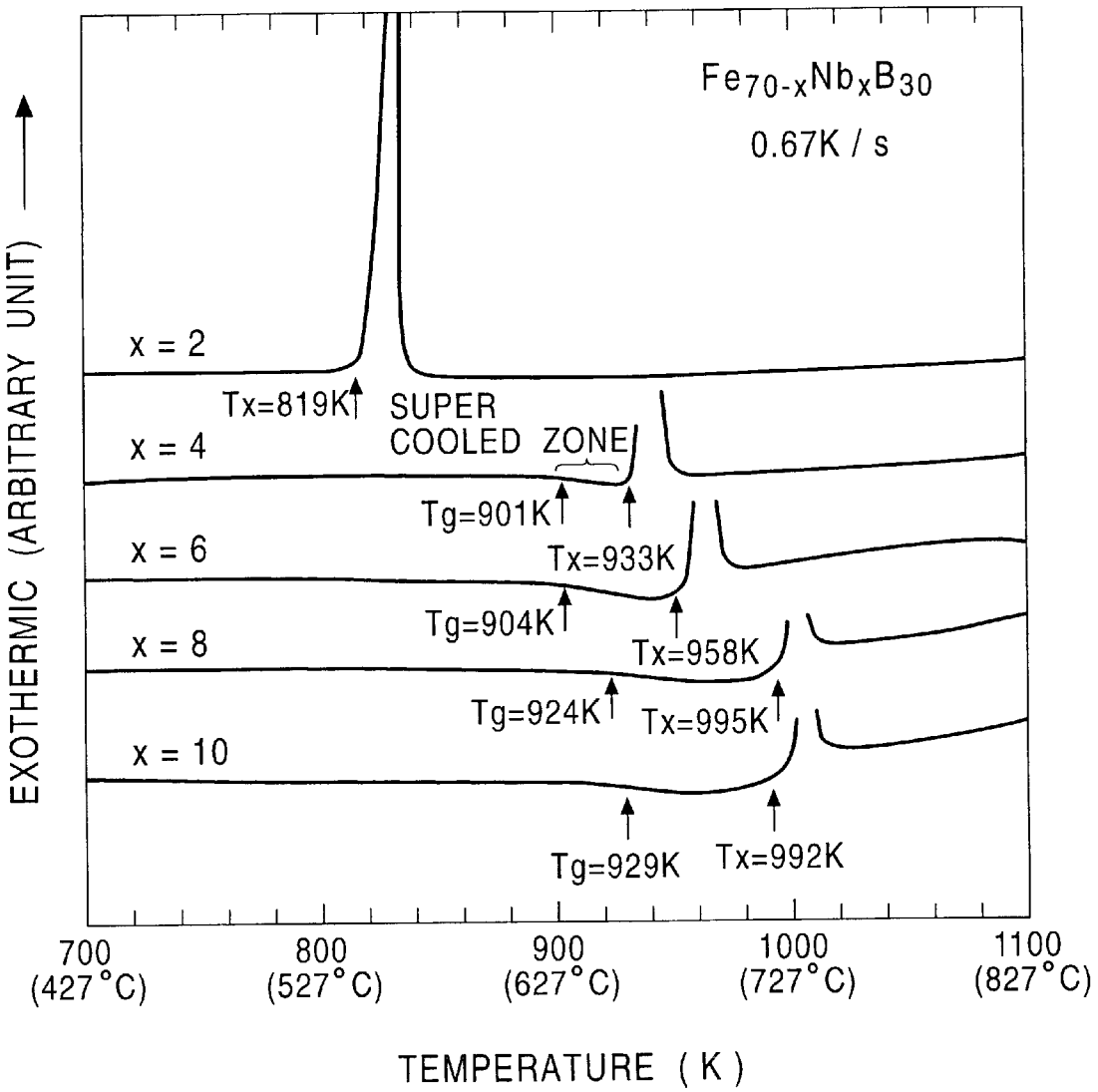
FIG. 2 is a chart showing a DSC curve of the sample having each of the compositions shown in FIG. 1.

FIG. 2 shows a DSC curve of the sample having each of the compositions shown in FIG. 1.

FIG. 2 indicates that a sample containing 2 atomic % of Nb shows no super cooled liquid region even by increasing temperature, while samples containing 4 atomic % or more of Nb show the wide super cooled liquid region (super cooled zone) by increasing temperature, and are crystallized by heating beyond the super cooled liquid region. In all samples containing 4 atomic % or more of Nb shown in FIG. 2, the temperature interval ΔTx of the super cooled liquid region, which is represented by the equation ΔTx=Tx−Tg, exceeds 20° C. (K), and in the range of 32 to 71° C. (K). It is thus found that 4 atomic % or more of Nb is preferably added to a Fe-B system alloy.

Figure 3:
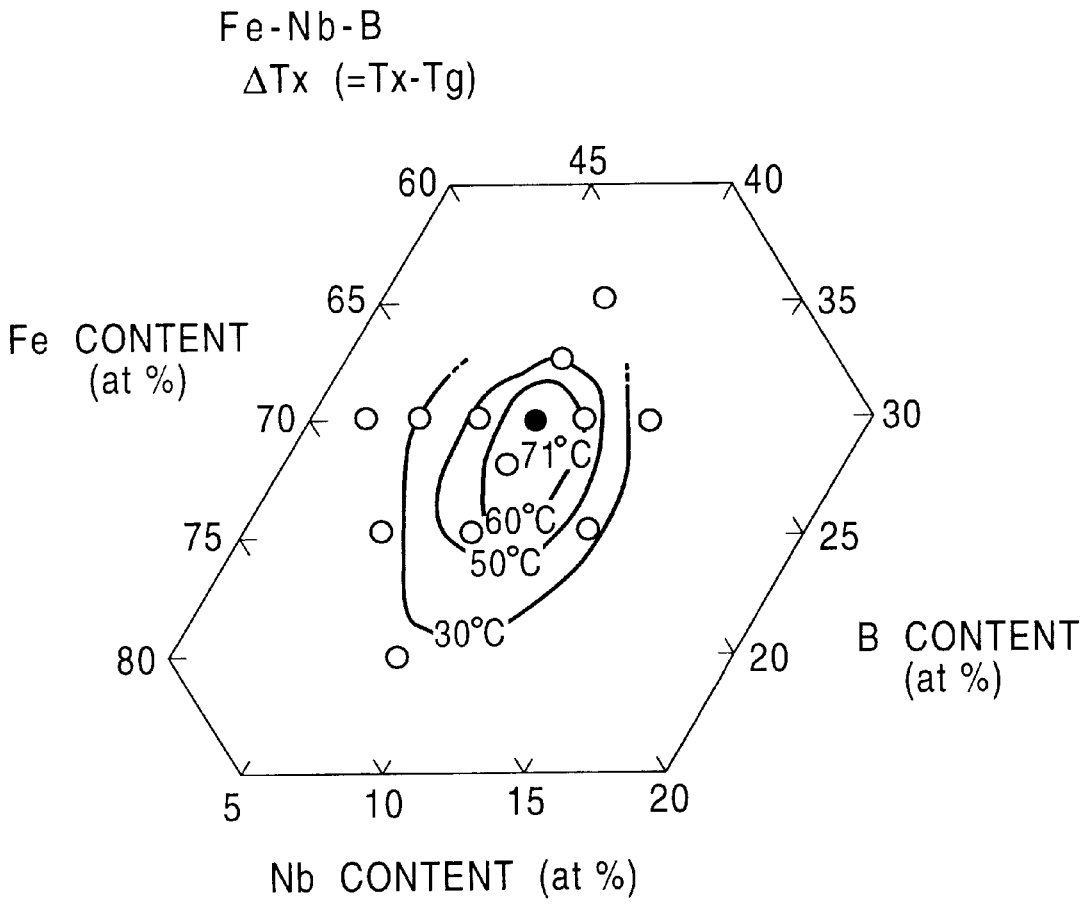
FIG. 3 is a triangular composition diagram showing the dependency of each of Fe, Nb and B contents on the value of ΔTx (=Tx−Tg) in the $Fe_{100-x-y}Nb_xB_y$ composition system.
Figure 4:
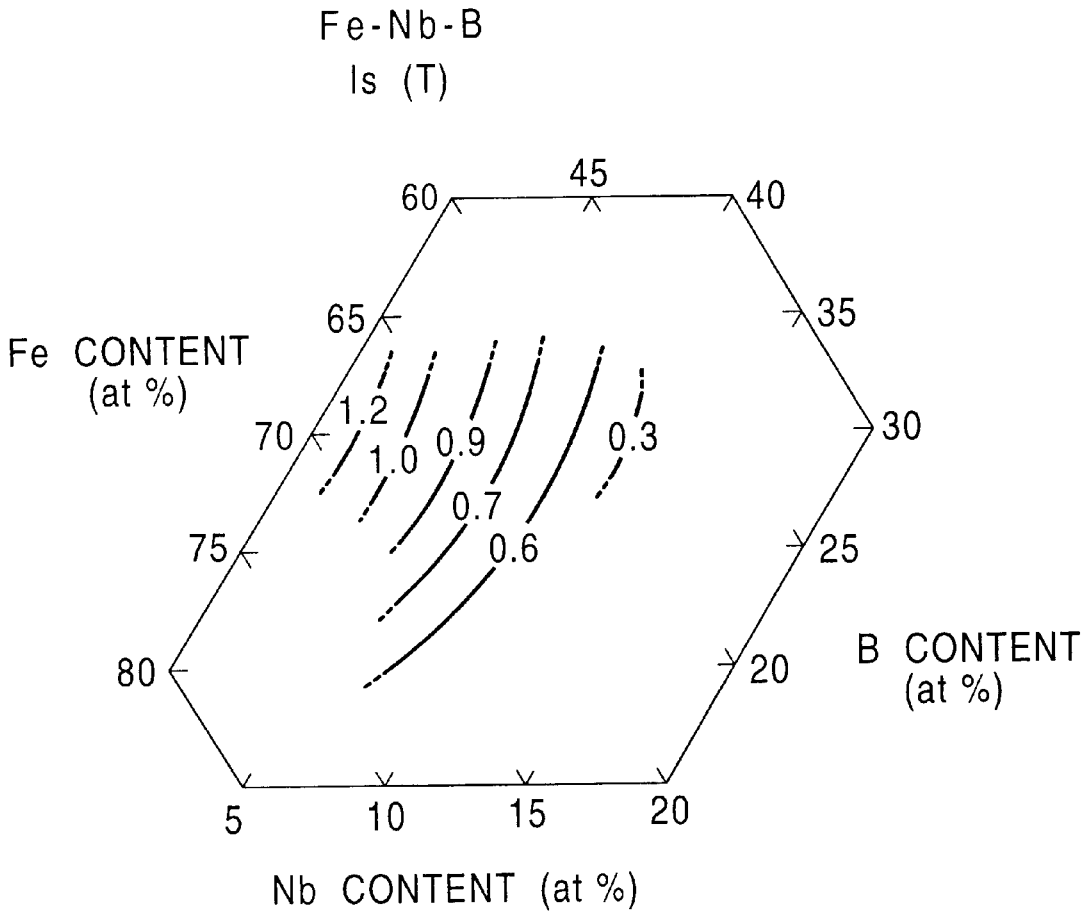
FIG. 4 is a triangular composition diagram showing the dependency of each of Fe, Nb and B contents on the value of saturation magnetization (Is) in the $Fe_{100-x-y}Nb_xB_y$ composition system.
Figure 5:
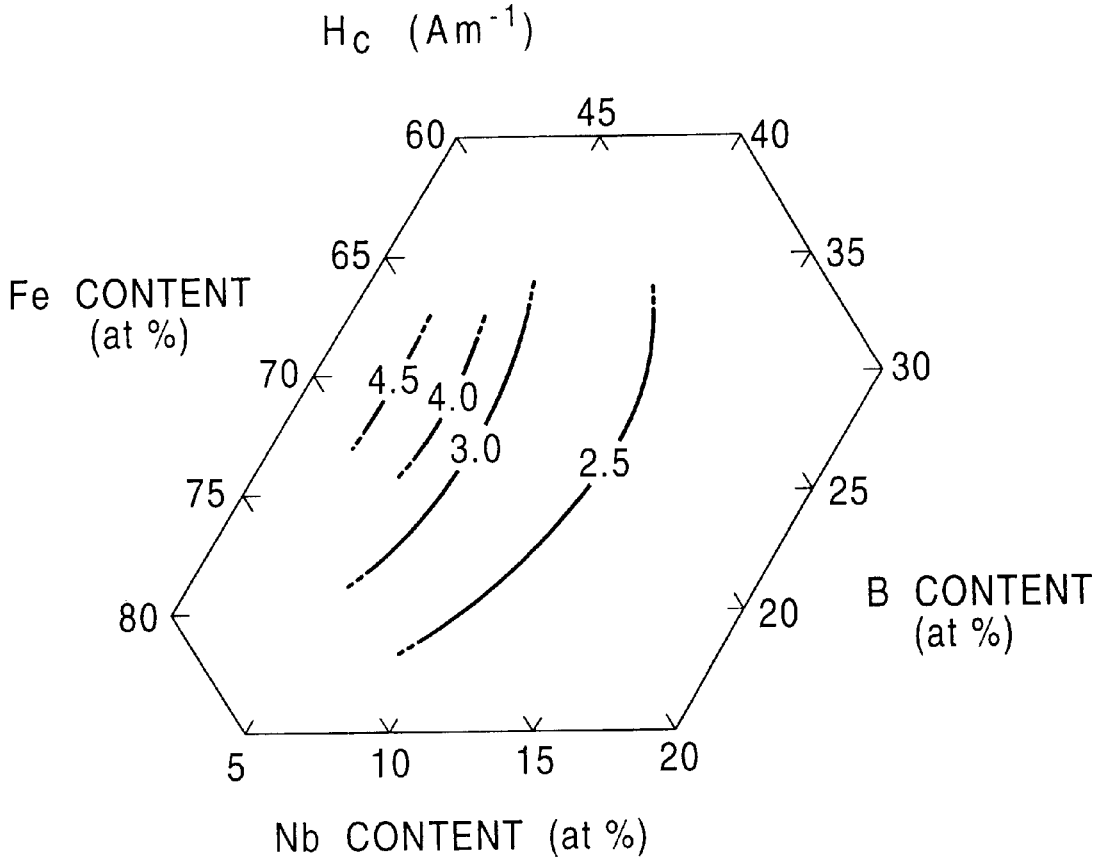
FIG. 5 is a triangular composition diagram showing the dependency of each of Fe, Nb and B contents on the value of coercive force (Hc) in the $Fe_{100-x-y}Nb_xB_y$ composition system.
Figure 6:
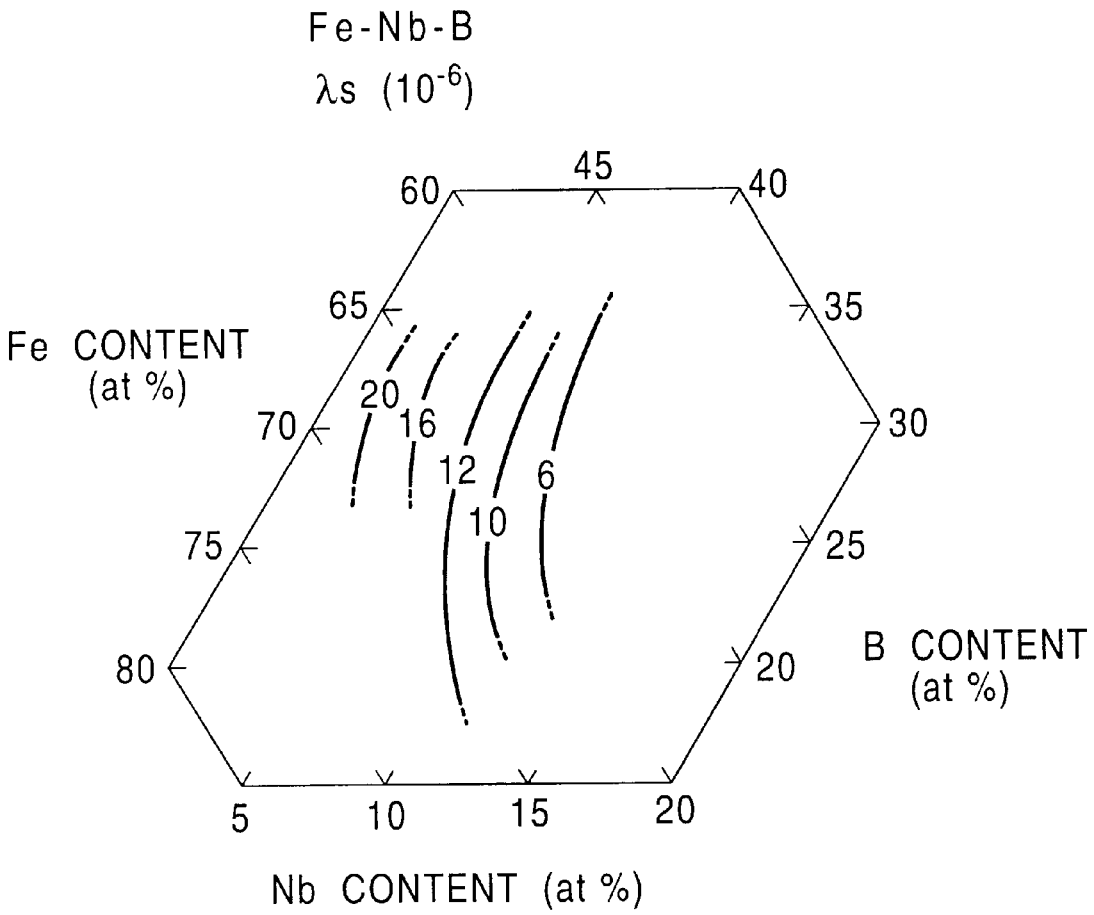
FIG. 6 is a triangular composition diagram showing the dependency of each of Fe, Nb and B contents on the value of magnetostriction (λs) in the $Fe_{100-x-y}Nb_xB_y$ composition system.
Figure 7:
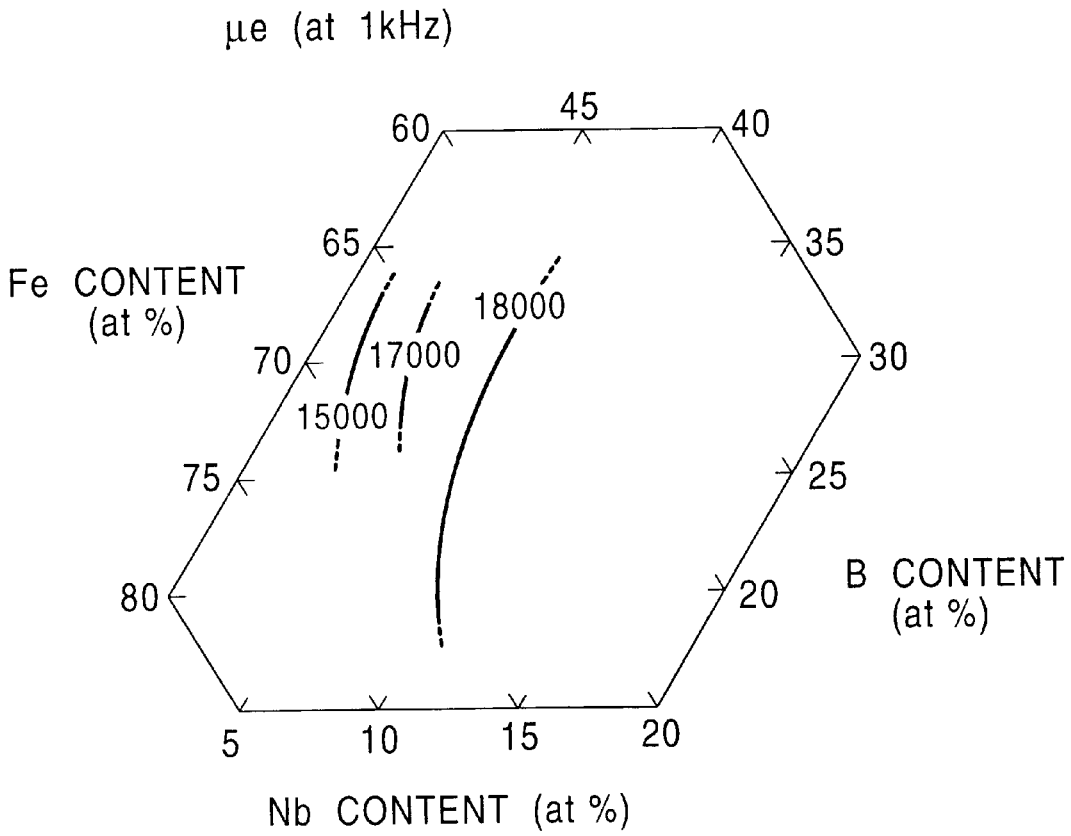
FIG. 7 is a triangular composition diagram showing the dependency of each of Fe, Nb and B contents on the value of magnetic permeability (μe) in the $Fe_{100-x-y}Nb_xB_y$ composition system.

FIG. 3 is a triangular composition diagram showing dependency of each of the Fe, Nb and B contents on the value of ΔTx (=Tx−Tg) in the $Fe_{100-x-y}Nb_xB_y$ composition system. FIG. 4 a triangular composition diagram showing the dependency of each of Fe, Nb and B contents on the value of saturation magnetization (Is) in the same composition system. FIG. 5 is a triangular composition diagram showing the dependency of each of Fe, Nb and B contents on the value of coercive force (Hc) in the same composition system. FIG. 6 is a triangular composition diagram showing the dependency of each of Fe, Nb and B contents on the value of saturation magnetostriction (λs) in the same composition system. FIG. 7 is a triangular composition diagram showing the dependency of each of Fe, Nb and B contents on the value of magnetic permeability (μe) in the same composition system.

Table 1 below shows the measurement results of Tg, Tx, ΔTx, saturation magnetization (Is), coercive force ($Am^{-1}$), saturation magnetostriction (λs), and effective magnetic permeability (μe: 1 kHz) of samples having the composition $Fe_{70-x}Nb_xB_{30}$ (x=0, 2, 4, 6, 8 or 10 atomic %).

TABLE 1

| $Fe_{70-x}Nb_xB_{30}$ | Tg ° C.(K) | Tx ° C.(K) | ΔTx ° C.(K) | Is T | Hc $Am^{-1}$ | λs $10^{-6}$ | μe at 1 kHz |
|---|---|---|---|---|---|---|---|
| x = 2 | — | 546 (819K) | — | 1.23 | 4.8 | 22.0 | 15100 |
| x = 4 | 628 (901K) | 660 (933K) | 32 | 1.02 | 4.4 | 16.8 | 17200 |
| x = 6 | 631 (904K) | 685 (958K) | 54 | 0.88 | 3.2 | 12.4 | 17800 |
| x = 8 | 651 (924K) | 722 (995K) | 71 | 0.68 | 2.6 | 7.7 | 19300 |
| x = 10 | 656 (929K) | 719 (992K) | 63 | 0.46 | 2.7 | 5.4 | 19800 |

The results shown in FIG. 3 reveal that in the $Fe_{100-x-y}Nb_xB_y$ composition system, a composition containing a large amount of Fe shows a large value of ΔTx, and that in order to obtain ΔTx of 50° C. (K) or more, the B content and the Nb content are preferably 24 to 33 atomic % and 6 to 11 atomic %, respectively.

It is also found that in order to obtain ΔTx of 60° C. (K) or more, the B content and the Nb content are preferably 26 to 32 atomic % and 6 to 10 atomic %, respectively. It is further found that in order to obtain ΔTx of 71° C. (K), the B content and the Nb content are preferably 31 atomic % and 8 atomic %, respectively.

Comparison of FIGS. 4, 5, 6 and 7 with FIG. 3 indicates that in the region of high ΔTx, saturation magnetization (Is), coercive force (Hc), magnetic permeability (μe) and saturation magnetostriction (λs) are substantially good.

Figure 8:
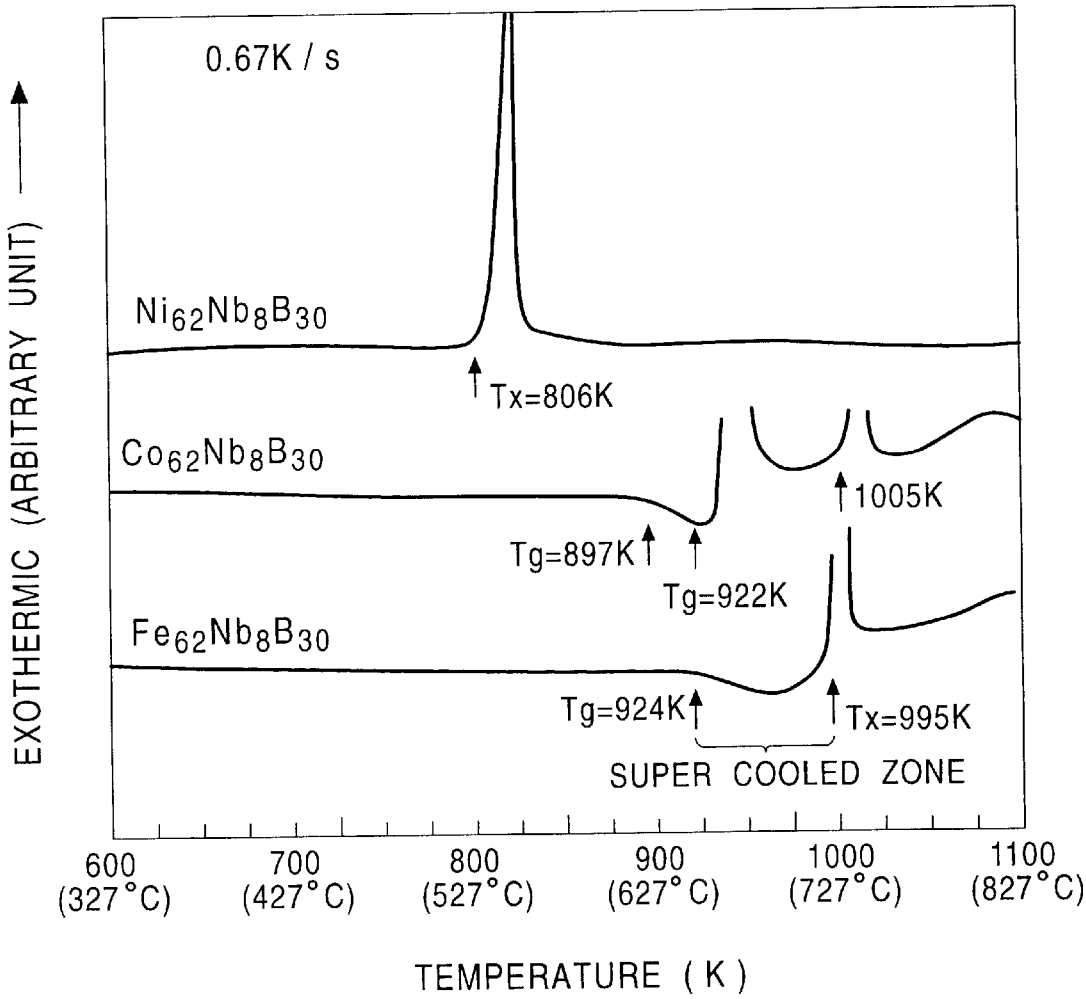
FIG. 8 is a chart showing DSC curves of as-quenched samples having the composition $T_{62}Nb_8B_{30}$ (T=Fe, Co or Ni) in production by the single roll method.

FIG. 8 shows DSC curves of as-quenched samples having the composition $T_{62}Nb_8B_{30}$ (T=Fe, Co or Ni) in production by the single roll method.

The results shown in FIG. 8 indicate that in the $T_{62}Nb_8B_{30}$ composition system, a sample in which T is Ni shows no super cooled liquid region even by increasing temperature, while a sample in which T is Fe or Co shows a wide super cooled liquid region in an equilibrium state in a temperature region lower than the exothermic peak temperature which indicates crystallization. However, a sample having the composition $Co_{62}Nb_8B_{30}$ shows a two-step exothermic peak. It is thus found that Fe is preferably contained as T in this system alloy.

Figure 9:
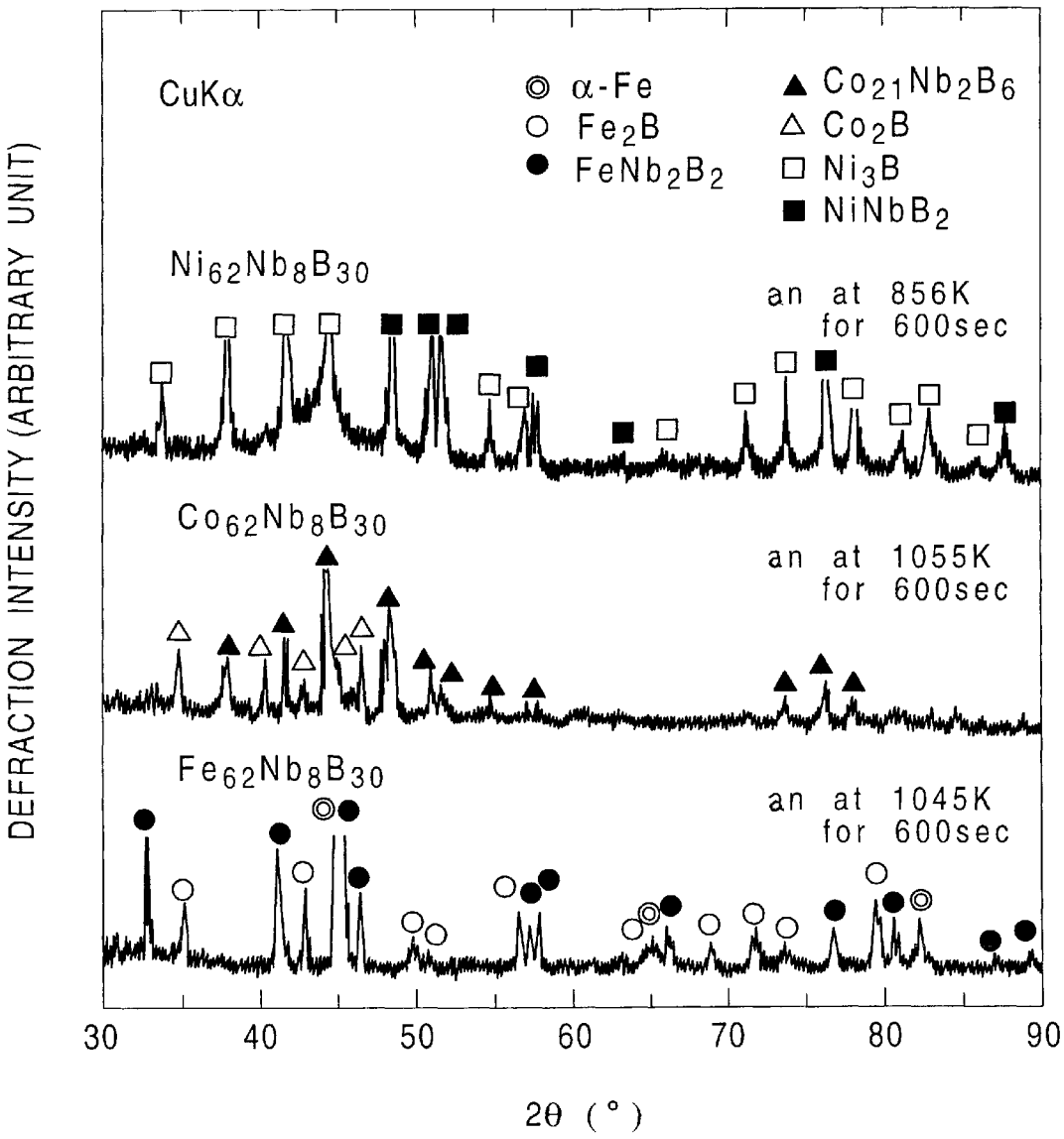
FIG. 9 is a chart showing results of X ray diffraction of metal glassy alloy samples having the composition $T_{62}Nb_8B_{30}$ (T=Fe, Co or Ni) after annealing for 10 minutes at a temperature at which an exothermic peak occurs.

FIG. 9 shows the results of X ray diffraction of metal glassy alloy samples having the composition $T_{62}Nb_8B_{30}$ (T=Fe, Co or Ni) after annealing for 10 minutes at a temperature at which an exothermic peak appears. In FIG. 9, an α-Fe peak is marked with ©; a $Fe_2B$ peak, o; a $FeNb_2B_2$ peak, ·; a peak, ▲; a $CO_2B$ peak, Δ; a $Ni_3B$ peak, □; a $NiNbB_2$ peak, ■.

In a sample having the composition $Ni_{62}Nb_8B_{30}$ and showing only one exothermic peak, as shown in FIG. 8, peaks of $Ni_3B$ and $NiNbB_2$ are observed even after treatment at the exothermic peak temperature of 583° C. (856K) for 600 seconds.

In a sample having the composition $Co_{62}Nb_8B_{30}$ and showing two exothermic peaks, as shown in FIG. 8, peaks of $Co_{21}Nb_2B_6$ and $Co_2B$ are observed after treatment at a temperature of 782° C. (1055K) near the second exothermic peak for 600 seconds.

In a sample having the composition $Fe_{62}Nb_8B_{30}$ and showing only one exothermic peak, as shown in FIG. 8, peaks of α-Fe, $Fe_2B$ and $FeNb_2B_2$ are observed even after treatment at the exothermic peak temperature of 772° C. (1045K) for 600 seconds.

These results indicate that in a sample showing only one exothermic peak, such as the sample having the composition $Ni_{62}Nb_8B_{30}$ and the sample having the composition $Fe_{62}Nb_8B_{30}$, α-Fe, $Fe_2B$ and $FeNb_2B_2$ or $Ni_3B$ and $NiNbB_2$ are precipitated from an amorphous phase during crystallization, while the sample showing two exothermic peaks such as the sample having the composition $Co_{62}Nb_8B_{30}$, $Co_{21}Nb_2B_6$ and $Co_2B$ are precipitated at the second exothermic peak.

Figure 10:
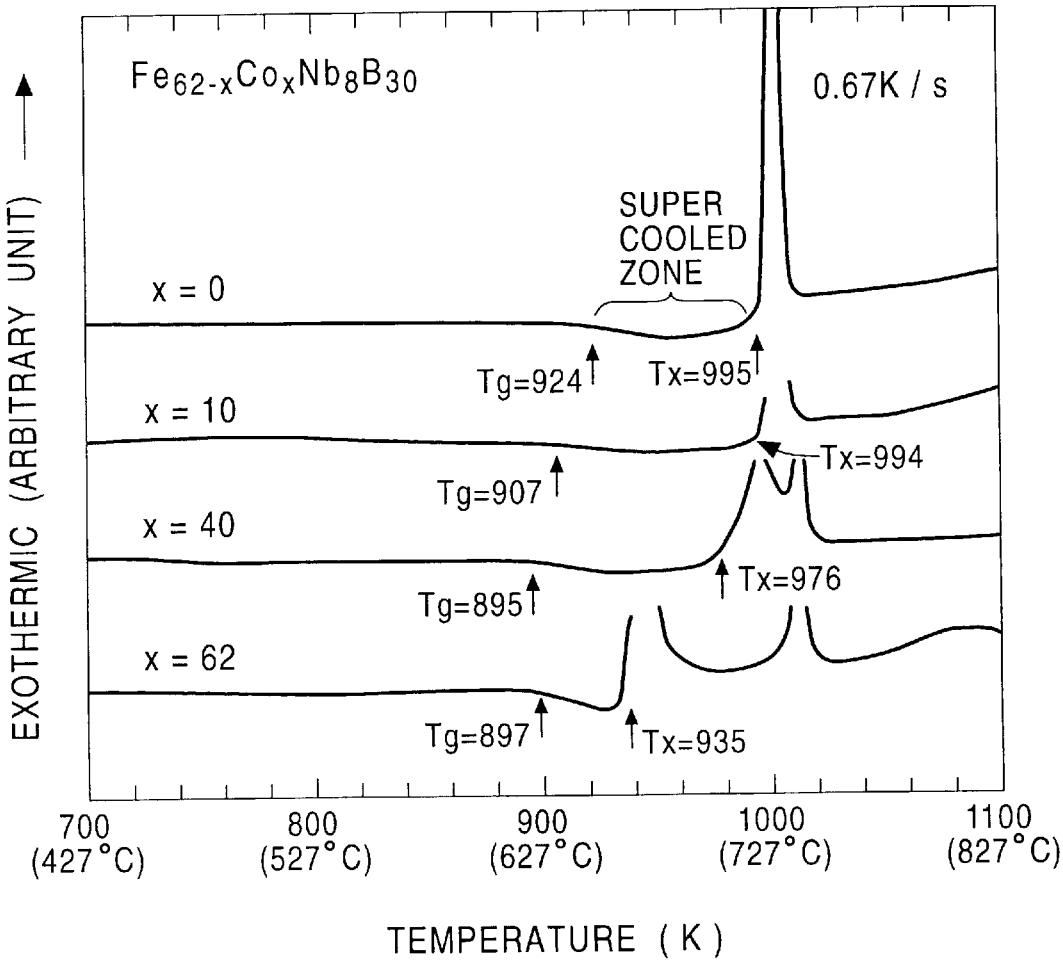
FIG. 10 is a chart showing DSC curves of as-quenched samples having the composition $Fe_{62-x}Co_xNb_8B_{30}$ (x=0, 10, 40 or 62 in production by the single roll method.

FIG. 10 shows DSC curves of as-quenched samples having the composition $Fe_{62-x}Co_xNb_8B_{30}$ (x=0, 10, 40 or 62) in production by the single roll method.

The results shown in FIG. 10 indicate that in all samples, a wide super cooled liquid region in an equilibrium state is present in a temperature region lower than the exothermic peak temperature which shows crystallization. However, the samples respectively having the compositions $Fe_{22}Co_{40}Nb_8B_{30}$ and $Fe_{62}Nb_8B_{30}$ show a two-step exothermic peak.

Figure 11:
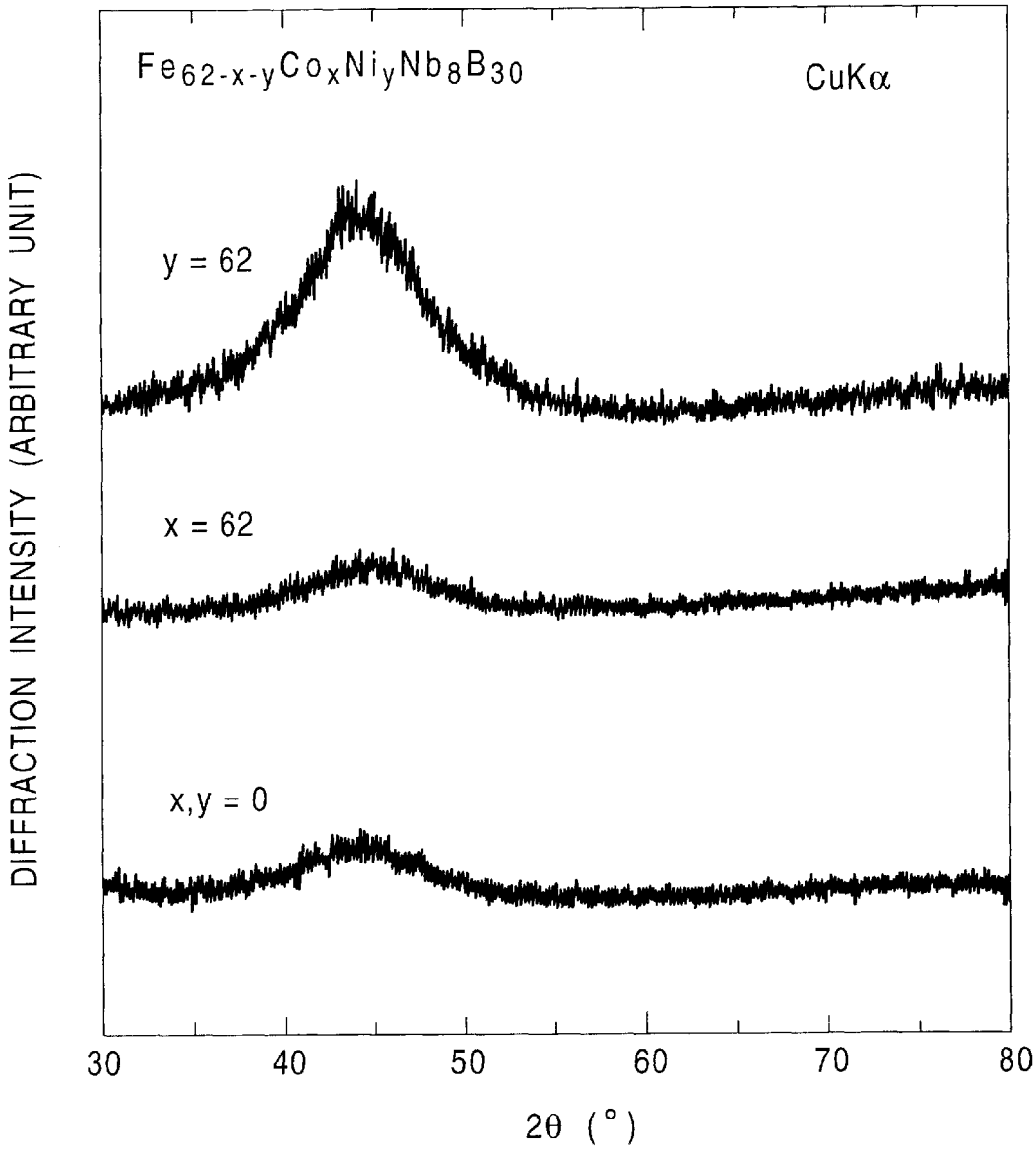
FIG. 11 is a chart showing X ray diffraction patterns of as-quenched samples having the composition $Fe_{62-x-y}Co_xNi_yNb_8B_{30}$ (x and y=0, or x=62 and y=62 atomic A) in production by the single roll method.

FIG. 11 shows X ray diffraction patterns of as-quenched samples having the composition $Fe_{62-x-y}Co_xNi_yNb_8B_{30}$ (x and y=0, or x=62 and y=62 atomic %) in production by the single roll method.

It is found that the X ray diffraction patterns of all samples are typical board patterns showing an amorphous phase, and these samples are apparently amorphous, and that the amorphous forming ability can be improved by decreasing the amounts of Ni and Co added.

Figure 12:
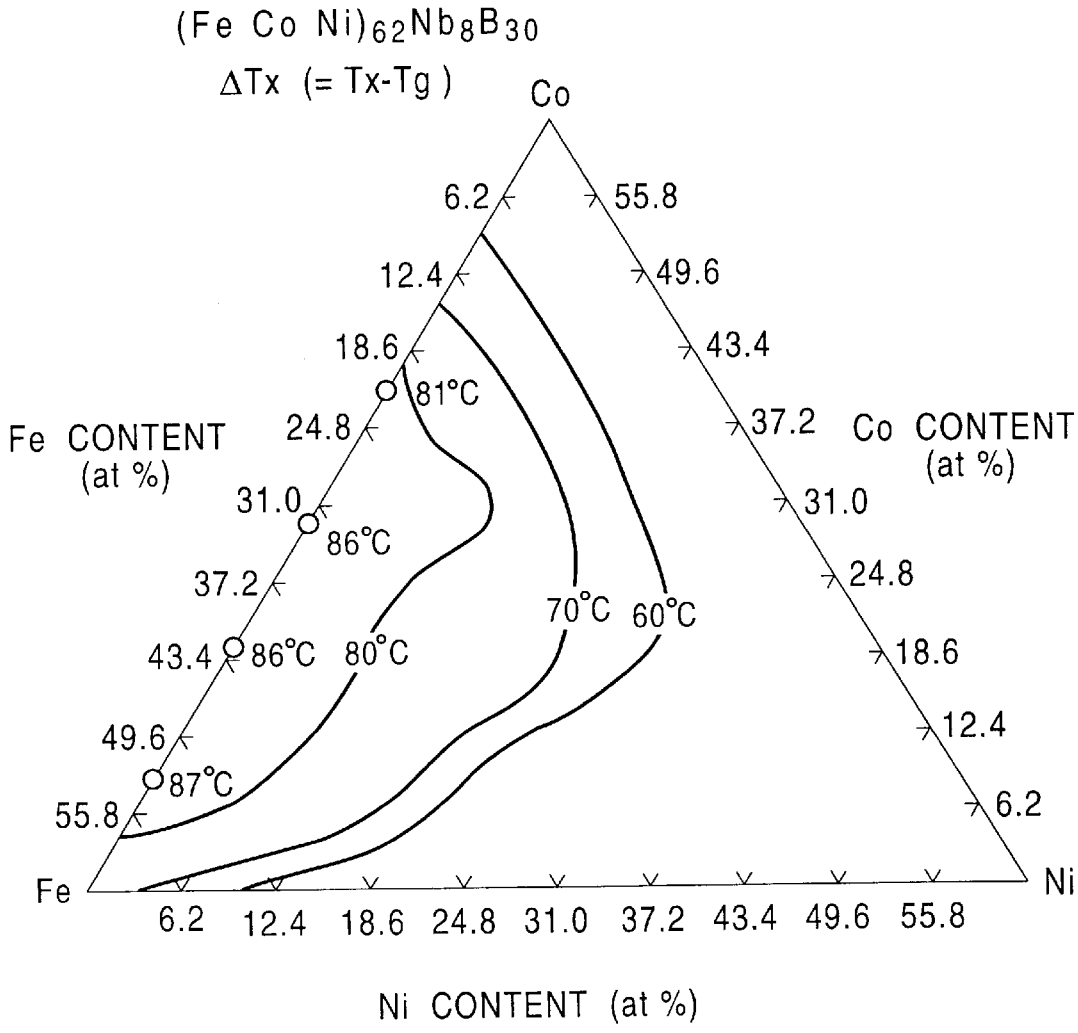
FIG. 12 is a triangular composition diagram showing the dependency of each of Fe, Co and Ni contents on the value of ΔTx (=Tx−Tg) in the $(FeCoNi)_{62}Nb_8B_{30}$ composition system.
Figure 13:
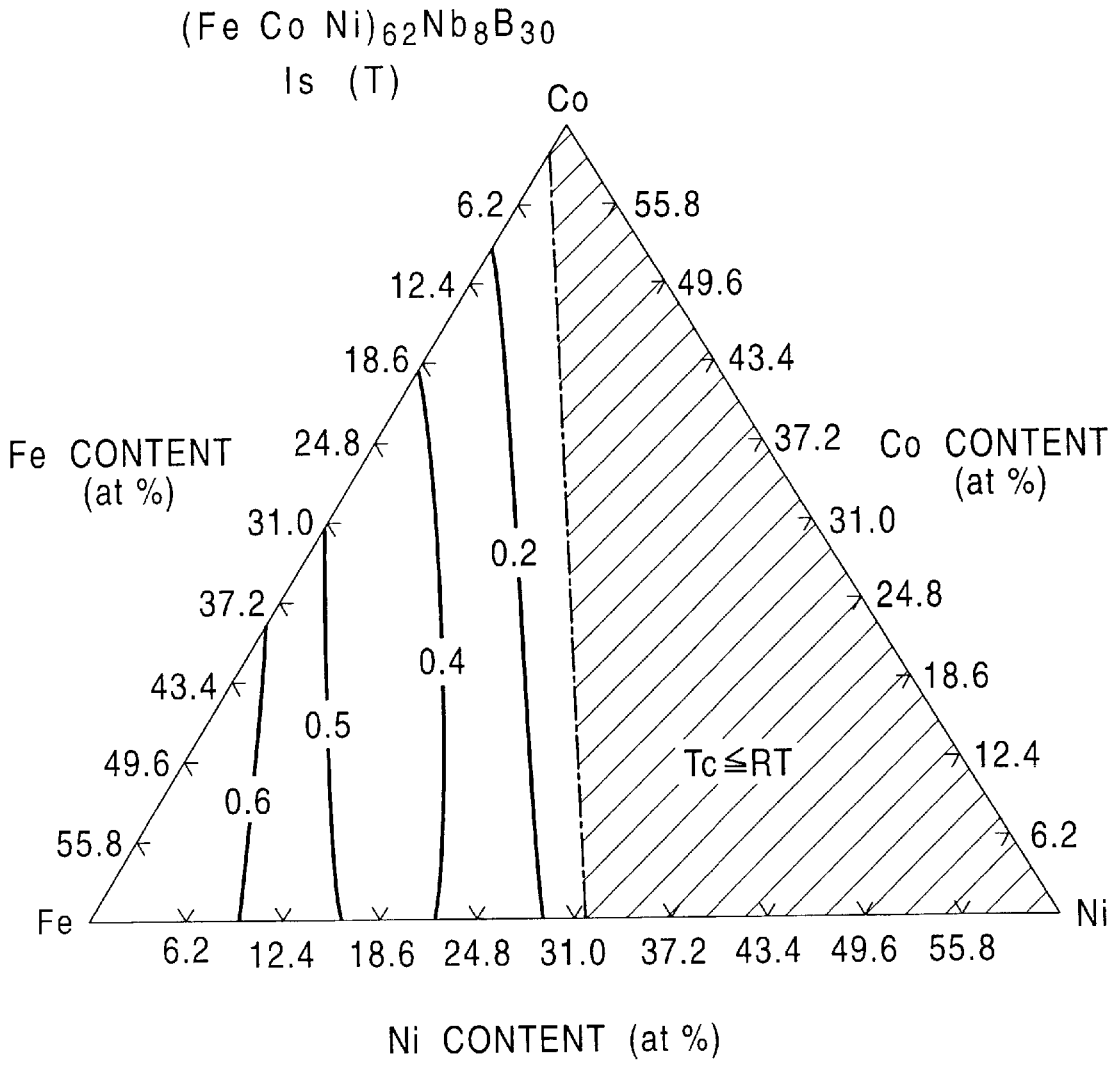
FIG. 13 is a triangular composition diagram showing the dependency of each of Fe, Co and Ni contents on the value of saturation magnetization (Is) in the $(FeCoNi)_{62}Nb_8B_{30}$ composition system.
Figure 14:
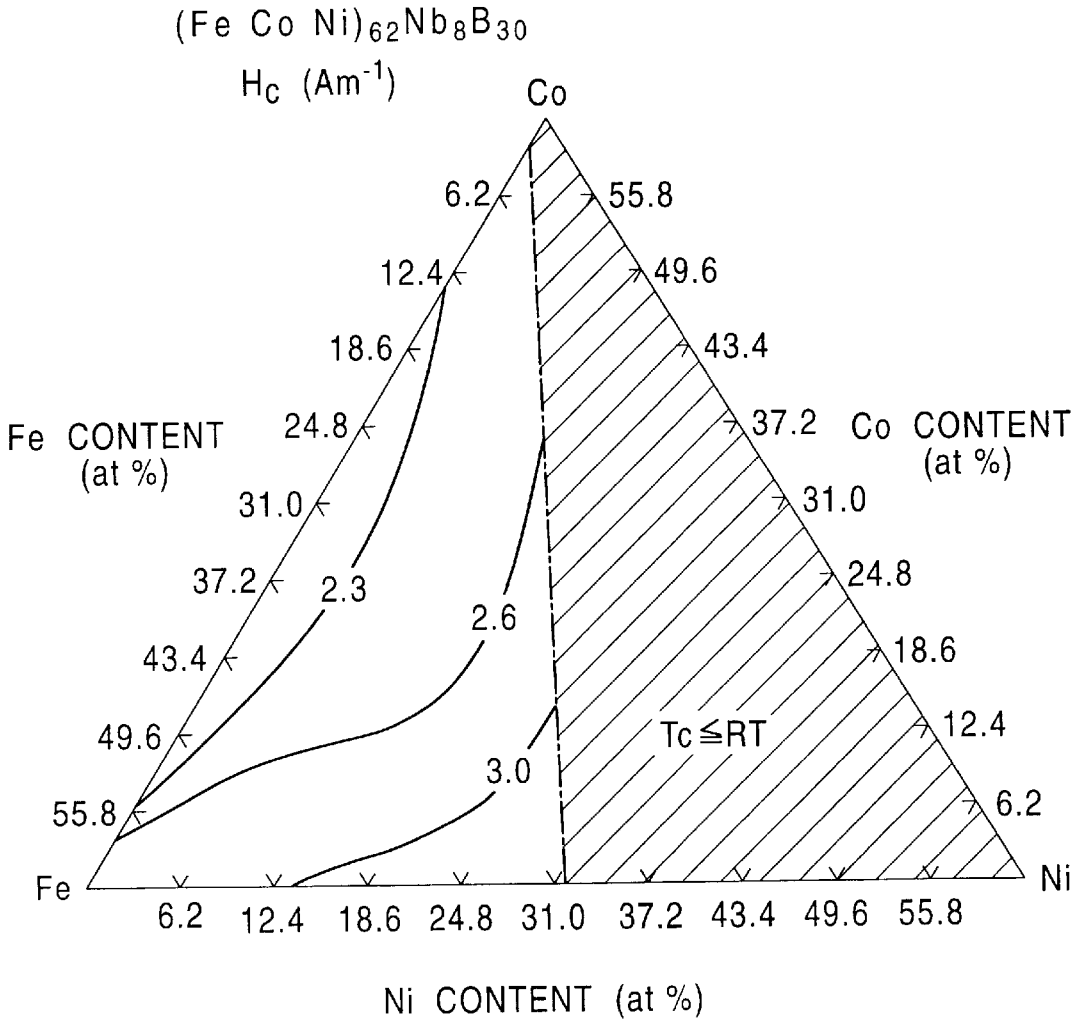
FIG. 14 is a triangular composition diagram showing the dependency of each of Fe, Co and Ni contents on the value of coercive force (Hc) in the $(FeCoNi)_{62}Nb_8B_{30}$ composition system.
Figure 15:
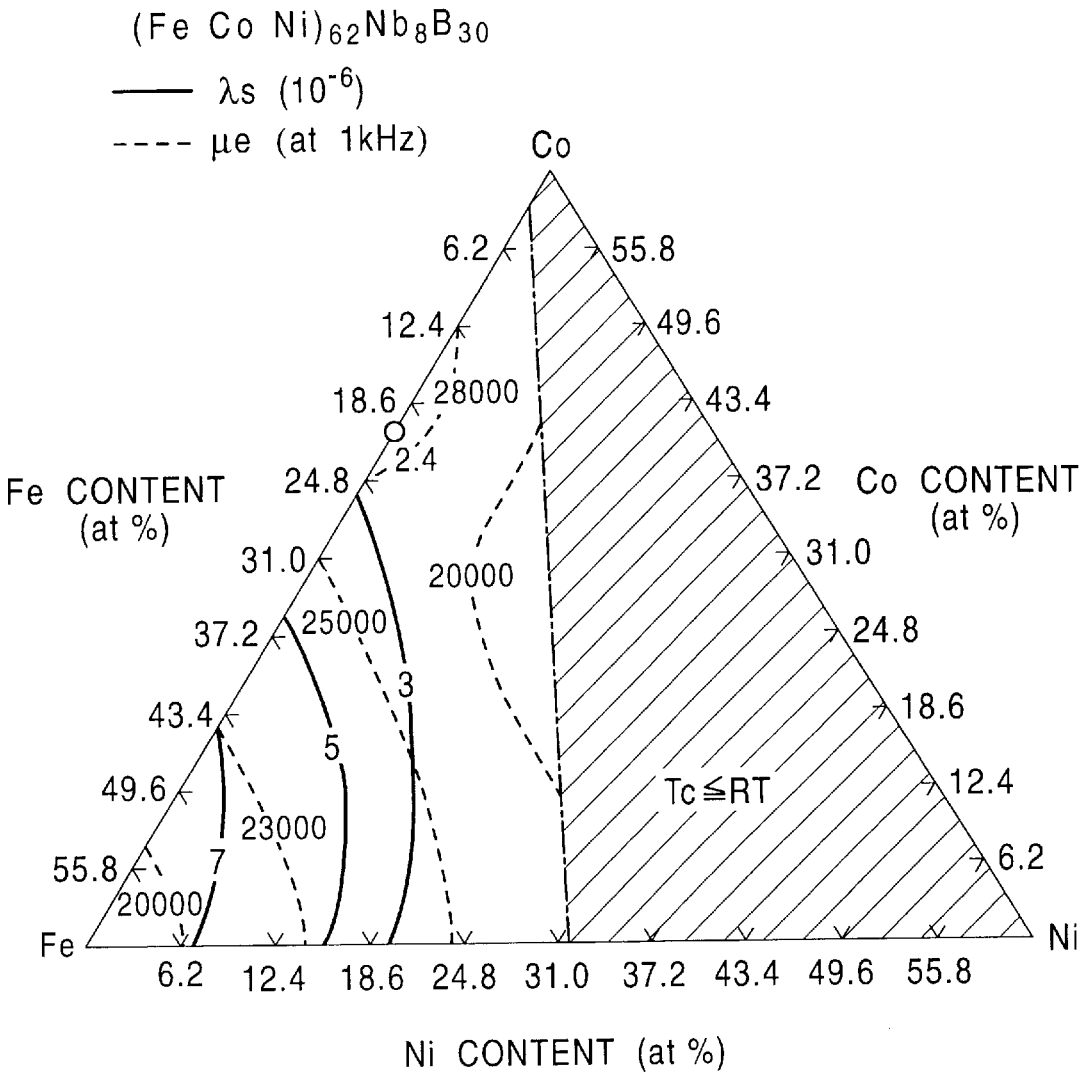
FIG. 15 is a triangular composition diagram showing the dependency of each of Fe, Co and Ni contents on the values of magnetic permeability (μe) and saturation magnetostriction (λs) in the $(FeCoNi)_{62}Nb_8B_{30}$ composition system.

FIG. 12 is a triangular composition diagram showing the dependency of each of Fe, Co and Ni contents on the value of ΔTx (=Tx−Tg) in the $(FeCoNi)_{62}Nb_8B_{30}$ composition system. FIG. 13 is a triangular composition diagram showing the dependency of each of Fe, Co and Ni contents on the value of saturation magnetization (Is) in the same composition system. FIG. 14 is a triangular composition diagram showing the dependency of each of Fe, Co and Ni contents on the value of coercive force (Hc) in the same composition system. FIG. 15 is a triangular composition diagram showing the dependency of each of Fe, Co and Ni contents on the values of magnetic permeability (μe) and saturation magnetostriction (λs) in the same composition system.

The results shown in FIG. 12 indicate that in the $(FeCoNi)_{62}Nb_8B_{30}$ composition system, ΔTx increases as the Co content increases, and the Ni content decreases, and that a wide ΔTx of over 80° C. (K) is also obtained in a composition system containing 40 atomic % (at %) of Co, and a wide ΔTx of 87° C. (K) is also obtained in a composition system containing 10 atomic % (at %) of Co.

Comparison of FIGS. 13, 14 and 15 with FIG. 12 reveals that in the region of high ΔTx, saturation magnetization (Is), coercive force (Hc), magnetic permeability ($\mu e$) and saturation magnetostriction ($\lambda s$) are substantially good.

Figure 16:
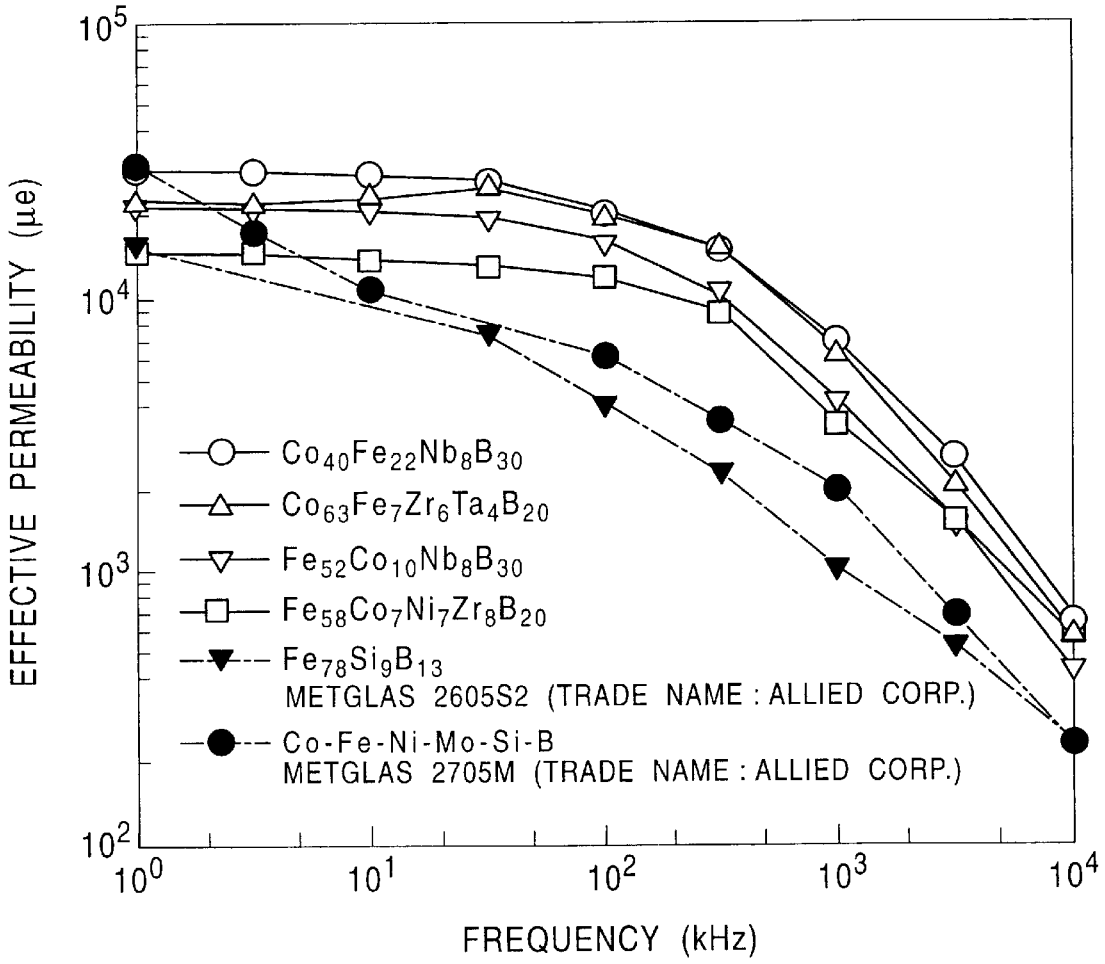
FIG. 16 is a graph showing frequency dependency of the effective permeability of each of a ribbon sample having the composition $Co_{40}Fe_{22}Nb_8B_{30}$, a ribbon sample having the composition $Fe_{52}Co_{10}Nb_8B_{30}$, a ribbon sample having the composition $Fe_{58}Co_7Ni_7Zr_8B_{20}$, a ribbon sample having the composition $Co_{63}Fe_7Zr_6Ta_4B_{20}$, a ribbon sample having the composition $Fe_{78}Si_9B_{13}$, and a Co—Fe—Ni—Mo—Si—B system ribbon sample.

FIG. 16 showing the results of examination of the relation between the operating frequency and the effective permeability of each of a ribbon sample having the composition $Co_{40}Fe_{22}Nb_8B_{30}$ and a ribbon sample having the composition $Fe_{52}Co_{10}Nb_8B_{30}$, which were produced by the same single roll method and then heated at a holding temperature of 584° C. (857K) for a holding time of 600 seconds.

For comparison, FIG. 16 also shows the results of examination of the relation between the operating frequency and the effective permeability of each of a ribbon sample having the composition $Fe_{58}Co_7Ni_7Zr_8B_{20}$ which was were produced by the same single roll method and then heated at a holding temperature of 498° C. (771K) for a holding time of 600 seconds, and a ribbon sample having the composition $Co_{63}Fe_7Zr_6Ta_4B_{20}$, which was produced by the same single roll method and then heated at a holding temperature of 535° C. (808K) for a holding time of 600 seconds. For comparison, FIG. 16 further shows the results of examination of the relation between the operating frequency and the effective permeability of each of a ribbon sample METGLAS2605S2 (trade name; Allied Corp.) comprising $Fe_{78}Si_9B_{13}$, and a Co—Fe—Ni—Mo—Si—B system ribbon sample of METGLAS2705M (trade name; Allied Corp.).

Table 2 below shows the measurement results of Tg, Tx, ΔTx, saturation magnetization (Is), coercive force ($Am^{-1}$), saturation magnetostriction ($\lambda s$), effective magnetic permeability ($\mu e$: 1 kHz), and resistivity ($\rho_{RT}$) at room temperature of the ribbon sample having the composition $Co_{40}Fe_{22}Nb_8B_{30}$, the ribbon sample having the composition $Fe_{52}Co_{10}Nb_8B_{30}$, the ribbon sample having the composition $Fe_{58}Co_7Ni_7Zr_8B_{20}$, the ribbon sample having the composition $CO_{63}Fe_7Zr_6Ta_4B_{20}$, the ribbon sample of METGLAS2605S2 (trade name; Allied Corp.) comprising $Fe_{78}Si_9B_{13}$, and the Co—Fe—Ni—Mo—Si—B system ribbon sample of METGLAS2705M (trade name; Allied Corp.).

TABLE 2

| | Tg ° C. (K) | Tx ° C. (K) | ΔTx ° C. (K) | Is T | Hc $Am^{-1}$ | $\lambda s$ $10^{-6}$ | $\mu e$ at 1 kHz | $\rho_{RT}$ $\mu\Omega \cdot cm$ |
|---|---|---|---|---|---|---|---|---|
| $Fe_{58}Co_7Ni_7Zr_8B_{20}$ | 548 (821 K) | 626 (899 K) | 78 | 0.98 | 4.8 | 16 | 15000 | 198 |
| $Fe_{52}Co_{10}Nb_8B_{30}$ | 634 (907 K) | 721 (994 K) | 87 | 0.63 | 2.1 | 7.4 | 21000 | 232 |
| $Co_{63}Fe_7Zr_6Ta_4B_{20}$ | 585 (858 K) | 622 (895 K) | 37 | 0.54 | 3.4 | 1.7 | 23000 | 193 |
| $Co_{40}Fe_{22}Nb_8B_{30}$ | 622 (895 K) | 703 (976 K) | 81 | 0.41 | 2.0 | 2.4 | 29300 | 237 |
| $Fe_{78}Si_9B_{13}$ (METGLAS 2605S2) | — | 550 (823 K) | — | 1.56 | 2.4 | 27 | 15000 | 137 |
| Co-Fe-Ni-Mo-Si-B (METGLAS 2705M) | — | 520 (793 K) | — | 0.7 | 0.4 | <1 | 30000 | 136 |

FIG. 16 and Table 2 indicate that in the ribbon sample comprising $Fe_{78}Si_9B_{13}$, and the Co—Fe—Ni—Mo—Si—B system ribbon sample as comparative examples, the effective magnetic permeability rapidly decreases as the operating frequency increases, and that large variations occur in characteristics according to the operating frequency. In these ribbon samples as comparative examples, in the frequency region of 50 kHz or more, the effective permeability is lower than the ribbon sample having the composition $Co_{40}Fe_{22}Nb_8B_{30}$, and the ribbon sample having the composition $Fe_{52}Co_{10}Nb_8B_{30}$, as examples of the present invention. In the frequency region of 1 kHz to 1000 kHz, the ribbon sample having the composition $Fe_{58}Co_7Ni_7Zr_8B_{20}$ as a comparative example shows a lower value of effective permeability than the ribbon sample having the composition $Co_{40}Fe_{22}Nb_8B_{30}$, and the ribbon sample having the composition $Fe_{52}C_{10}Nb_8B_{30}$ as the examples of the present invention. In addition, in the frequency region of 1 kHz or more, the ribbon sample having the composition $Co_{63}Fe_7Zr_6Ta_4B_{20}$ shows a lower value of effective permeability than the ribbon sample having the composition $Co_{40}Fe_{22}Nb_8B_{30}$ as the example of the present invention.

In the other hand, in the ribbon sample having the composition $Co_{40}Fe_{22}Nb_8B_{30}$, and the ribbon sample having the composition $Fe_{52}Co_{10}Nb_8B_{30}$ as the examples of the present invention, the effective magnetic permeability is substantially constant up to a frequency of about 50 kHz, and slowly decreases in the high frequency region of over 100 kHz. Although the ribbon sample having the composition $Co_{40}Fe_{22}Nb_8B_{30}$, and the ribbon sample having the composition $Fe_{52}Co_{10}Nb_8B_{30}$ as the examples of the present exhibit lower saturation magnetization than the ribbon sample having the composition $Fe_{58}Co_7Ni_7Zr_8B_{20}$, the samples as the examples of the present invention exhibit high effective magnetic permeability at 1 kHz, and resistivity higher than the samples of all comparative examples. Therefore, the samples of the examples are thought to cause low core loss even when used as core materials, and found to be excellent as high-frequency materials.

What is claimed is:

1. A high permeability metal glassy alloy for high frequency comprising at least one element of Fe, Co, and Ni as a main component, at least one element of Zr, Nb, Ta, Hf, Mo, Ti, V, Cr, and W, and B, wherein the temperature interval ΔTx of a super cooled liquid region, which is represented by the equation ΔTx is 20° C. or more, and resistivity is 200 $\mu\Omega\cdot$cm or more, wherein said high permeability metal glassy alloy is represented by the following composition formula:

$$(Fe_{1-a-b}Co_aNi_b)_{100-x-y}M_xB_y$$

wherein M is at least one element of Zr, Nb, Ta, Hf, Mo, Ti, V, Cr or W, $0 \leqq a \leqq 0.85$, $0 \leqq b \leqq 0.45$, 4 atomic $\% \leqq x \leqq 15$ atomic %, and 22 atomic $\% < y \leqq 33$ atomic % said high permeability metal glassy alloy further comprising (d) at least one element L selected from the group consisting of Ru, Rh, Pd, Os, Ir, Pt, Al, Ga, Si, Ge, C and P, the atomic ratio of $(Fe_{1-a-b}Co_aNi_b)$:L is 100−x−y−q:q, and $0 < q \leqq 10$.

2. A high permeability glassy alloy for high frequencies according to claim 1, wherein ΔTx is 50° C. or more, and wherein 5 atomic %≦x≦12 atomic %, and 22 atomic %<y≦33 atomic %.

3. A high permeability glassy alloy for high frequencies according to claim 1, wherein ΔTx is 60° C. or more, and wherein 6 atomic %≦x≦10 atomic %, and 25 atomic %≦y≦32 atomic %.

4. A high permeability glassy alloy for high frequencies according to claim 3, wherein ΔTx is 70° C. or more, and in the composition formula $(Fe_{1-a-b}Co_aNi_b)_{100-x-y}M_xB_y$, 0≦a≦0.75, and 0≦b≦0.35.

5. A high permeability glassy alloy for high frequencies according to claim 1, wherein ΔTx is 80° C. or more, and in the composition formula $(Fe_{1-a-b}Co_aNi_b)_{100-x-y}M_xB_y$, 0.08≦a≦0.65, and 0≦b≦0.2.

6. A high permeability metal glassy alloy for high frequencies according to claim 1, wherein magnetic permeability at 1 kHz is 20000 or more.

7. A high permeability metal glassy alloy for high frequencies according to claim 2, wherein magnetic permeability at 1 kHz is 20000 or more.

8. A high permeability metal glassy alloy for high frequencies according to claim 3, wherein magnetic permeability at 1 kHz is 20000 or more.

9. A high permeability metal glassy alloy for high frequencies according to claim 4, wherein magnetic permeability at 1 kHz is 20000 or more.

10. An alloy, comprising:

(a) at least one element T selected from the group consisting of Fe, Co, and Ni, (b) at least one element M selected from the group consisting of Zr, Nb, Ta, Hf, Mo, Ti, V, Cr, and W, and (c) B, wherein the atomic ratio of T:M:B is 100−x−y:x:y, 4≦x≦15, 22<y≦33, the atomic ratio of Fe:Co:Ni is 1−a−b:a:b, 0≦a≦0.85, and 0≦b≦0.45, the alloy further comprising (d) at least one element L selected from the group consisting of Ru, Rh, Pd, Os, Ir, Pt, Al, Ga, Si, Ge, C and P, the atomic ratio of T:L is 100−x−y−q:q, 0<q≦10, and wherein said alloy has a ΔTx of at least 20° C.

11. The alloy according to claim 10, wherein 5≦x≦12.

12. The alloy according to claim 10, wherein 6≦x≦10, and 25≦y≦32.

13. The alloy according to claim 10, wherein 0≦a≦0.75, and 0≦b≦0.35.

14. The alloy according to claim 10, wherein 0.08≦a≦0.65, and 0≦b≦0.2.

15. The alloy according to claim 10, wherein said alloy has a magnetic permeability at 1 kHz of at least 20000.

16. The alloy according to claim 10, wherein said alloy has a ΔTx of at least 70° C.

17. The alloy according to claim 10, wherein said alloy has a ΔTx of at least 80° C.

18. The alloy according to claim 10, wherein said alloy is a glassy alloy.

19. An alloy, comprising:

(a) at least one element T selected from the group consisting of Fe, Co, and Ni, (b) at least one element M selected from the group consisting of Zr, Nb, Ta, Hf, Mo, Ti, V, and W, and (c) B, wherein the atomic ratio of T:M:B is 100−x−y:x:y, 4≦x≦15, and 22<y≦33, the atomic ratio of Fe:Co:Ni is 1−a−b:a:b, 0≦a≦0.85, and 0≦b≦0.45, the alloy further comprising (d) at least one element L selected from the group consisting of Ru, Rh, Pd, Os, Ir, Pt, Al, Ga, Si, Ge, C and P, the atomic ratio of T:L is 100−x−y−q:q, 0<q≦10, and wherein said alloy has a ΔTx of at least 20° C.

20. The alloy according to claim 19, wherein 5≦x≦12.

21. The alloy according to claim 19, wherein 6≦x≦10, and 25≦y≦32.

22. The alloy according to claim 19, wherein 0≦a≦0.75, and 0≦b≦0.35.

23. The alloy according to claim 19, wherein 0.08≦a≦0.65, and 0≦b≦0.2.

24. The alloy according to claim 19, wherein said alloy has a magnetic permeability at 1 kHz of at least 20000.

25. The alloy according to claim 19, wherein said alloy has a ΔTx of at least 70° C.

26. The alloy according to claim 19, wherein said alloy has a ΔTx of at least 80° C.

27. The alloy according to claim 19, wherein said alloy is a glassy alloy.

28. An alloy, comprising:

(a) at least one element T selected from the group consisting of Fe, Co, and Ni, (b) at least one element M selected from the group consisting of Zr, Nb, Ta, Hf, Mo, Ti, V, Cr, and W, and (c) B, wherein the atomic ratio of T:M:B is 100−x−y:x:y, 4≦x≦15, 22<y≦33, wherein M includes Nb the alloy further comprising (d) at least one element L selected from the group consisting of Ru, Rh, Pd, Os, Ir, Pt, Al, Ga, Si, Ge, C and P, the atomic ratio of T:L is 100−x−y−q:q, 0<q≦10, and wherein said alloy has a ΔTx of at least 20° C.

29. An alloy, comprising:

(a) at least one element T selected from the group consisting of Fe, Co, and Ni, (b) at least one element M selected from the group consisting of Zr, Nb, Ta, Hf, Mo, Ti, V, and W, and (c) B, wherein the atomic ratio of T:M:B is 100−x−y:x:y, 4≦x≦15, and 22<y≦33, wherein M includes Nb the alloy further comprising (d) at least one element L selected from the group consisting of Ru, Rh, Pd, Os, Ir, Pt, Al, Ga, Si, Ge, C and P, the atomic ratio of T:L is 100−x−y−q:q, 0<q≦10, and wherein said alloy has a ΔTx of at least 20° C.

30. The alloy according to claim 28, wherein 5≦x≦12.

31. The alloy according to claim 28, wherein 6≦x≦10, and 25≦y≦32.

32. The alloy according to claim 28, wherein the atomic ratio of Fe:Co:Ni is 1−a−b:a:b, $0 \leqq a \leqq 0.85$, and $0 \leqq b \leqq 0.45$.

33. The alloy according to claim 32, wherein $0 \leqq a \leqq 0.75$, and $0 \leqq b \leqq 0.35$.

34. The alloy according to claim 32, wherein $0.08 \leqq a \leqq 0.65$, and $0 \leqq b \leqq 0.2$.

35. The alloy according to claim 28, wherein said alloy has a magnetic permeability at 1 kHz of at least 20000.

36. The alloy according to claim 28, wherein said alloy has a $\Delta Tx$ of at least 70° C.

37. The alloy according to claim 28, wherein said alloy has a $\Delta Tx$ of at least 80° C.

38. The alloy according to claim 28, wherein said alloy is a glassy alloy.

39. The alloy according to claim 29, wherein $5 \leqq x \leqq 12$.

40. The alloy according to claim 29, wherein $6 \leqq x \leqq 10$, and $25 \leqq y \leqq 32$.

41. The alloy according to claim 29, wherein the atomic ratio of Fe:Co:Ni is 1−a−b:a:b, $0 \leqq a \leqq 0.85$, and $0 \leqq b \leqq 0.45$.

42. The alloy according to claim 41, wherein $0 \leqq a \leqq 0.75$, and $0 \leqq b \leqq 0.35$.

43. The alloy according to claim 41, wherein $0.08 \leqq a \leqq 0.65$, and $0 \leqq b \leqq 0.2$.

44. The alloy according to claim 29, wherein said alloy has a magnetic permeability at 1 kHz of at least 20000.

45. The alloy according to claim 29, wherein said alloy has a $\Delta Tx$ of at least 70° C.

46. The alloy according to claim 29, wherein said alloy has a $\Delta Tx$ of at least 80° C.

47. The alloy according to claim 29, wherein said alloy is a glassy alloy.

* * * * *

UNITED STATES PATENT AND TRADEMARK OFFICE

CERTIFICATE OF CORRECTION

PATENT NO. : 6,350,323 B1
DATED : February 26, 2002
INVENTOR(S) : Akihisa Inoue et al.

It is certified that error appears in the above-identified patent and that said Letters Patent is hereby corrected as shown below:

Column 13,
Line 10, delete “claim 3,” and substitute -- claim 1, --

Signed and Sealed this

Twenty-fourth Day of June, 2003

JAMES E. ROGAN
*Director of the United States Patent and Trademark Office*